United States Patent [19]

Bissi

[11] 4,187,592

[45] Feb. 12, 1980

[54] METHOD FOR PRODUCING DECORATIVE FABRIC

[76] Inventor: Rebecca A. Bissi, 820 Forest Ave., Apt. E-2, Evanston, Ill. 60202

[21] Appl. No.: 936,733

[22] Filed: Aug. 25, 1978

[51] Int. Cl.[2] ..... D06C 23/00

[52] U.S. Cl. ..... 28/163; 28/164

[58] Field of Search ..... 26/69 R; 28/163, 164; 8/114

[56] References Cited

U.S. PATENT DOCUMENTS

| | | | |
|---|---|---|---|
| 1,185,245 | 5/1916 | Sadtler | 28/164 |
| 3,079,212 | 2/1963 | Fountain et al. | 28/163 |

FOREIGN PATENT DOCUMENTS

| | | | |
|---|---|---|---|
| 2125791 | 12/1972 | Fed. Rep. of Germany | 28/163 |
| 2602184 | 12/1976 | Fed. Rep. of Germany | 26/69 R |

*Primary Examiner*—Robert Mackey

*Attorney, Agent, or Firm*—Alter and Weiss

[57] ABSTRACT

An improved method for producing decorative fabric wherein a desired geometric design is imparted to fabric through specific dyeing processes. The fabric is smocked to form ridges and a plurality of dye applications to the smocked article promotes diffusion of the various dyes and associated colors through the fabric. The fabric is additionally stiffened to facilitate controlled, concentrated dye applications, after which, the fabric is returned to its original shape and finished.

21 Claims, 9 Drawing Figures

METHOD FOR PRODUCING DECORATIVE FABRIC

BACKGROUND OF THE INVENTION

The present invention refers in general to methods of coloring materials; and in particular, to an improved method for producing decorative fabric.

For literally thousands of years, dyes have been utilized to color and decorate fabrics. While dyes have been improved over these years and are easily obtainable and commercially available, the process through which such fabrics are dyed today remains relatively close to the manner in which they were dyed years ago throughout history.

More recently, as of the 1960's, a somewhat different dyeing technique has evolved. Tie-dyeing involves the clumping of a mass of material together with the binding of this clump to vary the amount of dye entering into the clump during the dyeing operation. Through such a dyeing technique, a radiating web is produced and the process continues to be used today for decorative purposes especially in the area of men and women's wearing apparel.

With either of the dyeing methods used to date, namely, that of bulk dyeing where an entire article is dyed one color by merely submerging the entire article in a dye solution; tye-dyeing as described above; and hand drawing where a design is actually painted by hand onto a fabric, it is often very difficult to control the degree of absorption with which the dye is taken by the fabric. For example, in hand painting, the coloring material (whether being a dye or not) may flow onto the fabric and stay at only the points at which it is deposited, while in other cases, diffusion between the material and liquid being deposited may distort the actual design being sought. The coloring material may often run, bleed or radiate in capillary fashion from a desired design parameter.

When utilizing a multitude of dyes and colors, it is also very difficult to control the boundaries between each the overlapping different colors, intensities or shades or to acquire an almost three-dimensional effect in two dimensions especially with a cellular-like design.

It is therefore an object of the present invention to describe a method of producing a decorative fabric which is relatively inexpensive and which provides for the producer a great degree of control over the placement and absorption of the coloration being used.

It is further an object of the present invention to facilitate the production of a design having three dimensional qualities embodied by a two-dimensional object which is capable of being used on fabric in a numerous variety of applications including upholstery, fabric wall decorations and wearing apparel.

It is further an object of the present invention to provide a unique coloring and processing technique capable of producing an interesting and exotic decorative fabric design which is not capable of being achieved through conventional dyeing techniques, which at the same time provides a method for such production which is clearly adaptable to machine production.

These and other aspects of the inventive process will become apparent in light of the present specification.

SUMMARY OF THE INVENTION

The present invention is an improved method for producing decorative fabric of the type wherein a desired geometric design is imparted onto a fabric with dyes. The method calls for the smocking of the fabric by gathering portions of the fabric into juxtaposition so as to form a plurality of ridges on a top side of the fabric. Preferably, the fabric is moistened with dye diffusion means for promoting the distribution of applied colors in the form of dyes. Next, a plurality of color dye means are applied to the exposed portions of the smocked fabric.

The smocked fabric is hardened so as to stiffen the ridges on the top side of the fabric to make the ridges capable of maintaining the original smocked "furrowed" arrangement, even when touched or manipulated. Further steps in the process include the application of a concentrated color dye against the upper portions of the ridges as well as the application of outlining to the uppermost peaks of the ridges with outlining medium.

After all the dyes and stiffening agents have dried, the juxtaposed portions of gathered fabric are released and the fabric is finished and returned to its substantially flat form for utilization as a decorative fabric for apparel, wall decorations and upholstery material.

In the preferred embodiment of the invention, the operation of smocking includes the superimposing of a horizontal and vertical linear array onto the top side of the fabric. While preferably a ½" by ½" array is utilized so as to form a series of ½" squares, other dimensioned arrays could be utilized. The actual intersection of the horizontal and vertical lines in such an array describe the points that actually meet in juxtaposition with one another when said fabric is gathered. Thus, the linear array describes a plurality of positions with standardized separated distances therebetween at which the gathering of the portions of fabric is performed.

The gathering is accomplished by attaching the portions of fabric into juxtaposition and by affixing these portions into their juxtaposed position through the utilization of material attachment means. Most preferably, such material attachment procedures are accomplished through the steps of stitching and sewing; but it should be realized that the invention contemplates the utilization of thermo-reactive fabric which can be attached and affixed at various locations through the application of heat. Through such a gathering operation, a plurality of ridges is formed on the top side of the fabric which, for the most part, is standard and uniform except for some ridge formations which are intentionally gathered oblique to the majority of the standard ridges so as to impart a more interesting deviating pattern to the fabric.

The smocked fabric is then moistened with dye diffusion means to promote the distribution of applied colors in the form of dyes. Particularly, the moistening is accomplished by spraying, in mist form, the bottom side of the fabric, opposite to the top side, with dye diffusion solution. This dye diffusion solution comprises a mixture of water and crystalline urea in the ratio of four cups to ten tablespoons, respectively. It should be noted that if substantially hard tap water is being used, it is recommended that a water softener compound be added. Such water softeners are readily available from one of several commercial water softener machinery concerns.

After the dye diffusion means has been used to moisten the fabric, to improve the diffusion characteristics of subsequently applied dyes, a plurality of color dye means are applied in succession to the generally exposed portions of the smocked fabric on the top side.

In the preferred embodiment of the invention, the method through which the application of the color dye means is applied is simultaneously performed with the procedure by which the smocked fabric is hardened or stiffened. Particularly, the color dye means are combined with a stiffening agent. This combination of dye means and stiffening agent is applied preferably by atomizer spray to the top side of the fabric and through natural absorption of the fabric as well as with the improved diffusion characteristics of the dye diffusion means, the fabric absorbs each of the applied plurality of dye means even into the unexposed portions of the smocked fabric. The stiffening agent is curable to harden the fabric as it dries so as to maintain the ridges in substantially their original smocked configuration even if the fabric or material is touched, manipulated or processed with any of the subsequent dyeing procedures.

Preferably, each one of the plurality of dye means comprises a fiber-reactive dye capable of reacting with alkalized soda. To this fiber-reactive dye is added baking soda, washing soda, water, and crystalline urea. The following ratios are exemplative of the preferred and effective chemical formulation. From ½ to 1 teaspoon of dye (depending upon the desired color intensity) is combined with ⅔ teaspoon baking soda, ⅓ teaspoon washing soda, 2½ tablespoons of crystalline urea, and 1 cup of water.

The preferred embodiment of formulation for the stiffening agent comprises a solution of sodium alginate, crystalline urea, and water. The preferred formulation has an exemplative ratio in which of ¼ to ½ teaspoon of sodium alginate (depending upon the desired stiffness to be achieved) is combined with 1 tablespoon of crystalline urea and ⅓ cup of water. It should be noted that in either of the formulations described above, whether for dye means or for stiffening agent, if the water has a substantially high mineral content or is "hard", it is preferred that a water softening agent be added to it.

In the preferred embodiment wherein the application of the dye means and the stiffening agent is done simultaneously by combining the described solutions, the application is accomplished through the steps of applying a first dye-agent mixture having a first substantially pale color over the exposed top surface of the fabric. A second dye-agent mixture having a second color substantially darker than the first pale color is then applied over the exposed area but to a lesser extent than the first color so that the first color is absorbed into a greater area of the fabric than the second dye-agent mixture. Preferably, the third dye-agent mixture having a third color substantially darker than the second color, is applied over an even lesser exposed area than that over which the second mixture was applied. The applications of said dye-agent mixtures are made without allowing the next preceeding application to dry, thereby promoting some overlapping and blending to occur between the different colors or between each of the different intensities of the respective dye-agent mixture compound applied to the fabric.

After the plurality of color dye means and the stiffening or hardening means are applied to the fabric, and while the fabric is still moist, not having been given the time to dry or cure, a concentrated color dye agent is applied to the upper portions of the ridges. This is preferably accomplished by actually painting the upper portions of the ridges with a substantially wide brush. As opposed to the previously-mentioned color dye means, the concentrated color agent comprises a solution of the same substances which were previously combined to obtain the dye means and stiffening agent. However, quantities have been changed because of the need to intensify the color of the concentrated dye while at the same time increasing the stiffening characteristics of the concentrated color dye. It should thus be realized that the concentrated color dye preferably combines a stiffening agent with its concentrated color dye agent. Thus, while fiber-reactive dye, baking soda, washing soda, water, crystalline urea and sodium alginate are used, the following exemplifying formulation is considered to be preferred. One to 1½ teaspoons of fiber-reactive dye (depending upon the desired color intensity) is added to ⅔ teaspoon baking soda, ⅓ teaspoon washing soda, and 5 tablespoons of crystalline urea, ¾ teaspoon sodium alginate and 2 cups of water. This concentrated color dye agent, which thus includes a stiffening compound, is then applied to the upper portions of the ridges which protrude substantially over the recessed portions so as to facilitate such a procedure.

After the color dye agent, stiffening agent, color dye means and the dye diffusion means have been cured through drying, the uppermost peaks of the ridges are outlined by painting with a substantially small brush with outlining medium. Since the ridges are relatively hard at this time, such an outlining procedure can be easily and accurately accomplished and the extent to which such outlining deviates from the uppermost peaks or has a tendency to migrate from said peaks is minimized. Preferably, the outlining medium comprises the combination of dyeing elements and stiffening agents which are even more concentrated than any of the previous solutions applied to the fabric up to this. An exemplifying formulation requires 1½ to 2 teaspoons of said dye together with ⅔ teaspoon baking soda, ⅓ teaspoon washing soda, 1 cup of water and 1 teaspoon of sodium alginate.

After this procedure, the juxtaposed portions of gathered fabric are released by severing the material attachment means such as for example, by snipping the threads which, up until this point, have smocked the fabric in the gathered relationship previously described.

Several steps for finishing are then followed including the steps of flattening the decorative fabric after releasing the gathered portions, as well as rinsing the fabric first in cold water, then in hot water until the bleeding of excess dye material ceases. The substantially flattened decorative fabric thereafter is capable of being ironed. Additionally, as in the case where the decorative fabric is used as a wall decoration by attachment over or within framing means, the finishing operation further includes the step of stretching the fabric so as to more effectively flatten and expose the imparted dye design.

It should be realized that virtually every one of the elements being used in the chemical formulations for either the dye means, stiffening agent, concentrated dye means or outlining medium are all commercially available, substantially common substances. The fiber-reactive dyes, for example, are available under the PROCION brand label as produced by Imperial Chemical Industries, Limited. Such PROCION brand dyes are especially effective on cotton, rayon, linen and silk materials of which linen or cotton velveteen are the preferred materials. The sodium alginate is marketed under the brand name HALLTEX and the crystalline urea, baking soda and washing soda are all commercially available through many retail distributors under a variety of brand names.

DETAILED DESCRIPTION OF THE DRAWINGS

Figure 1:
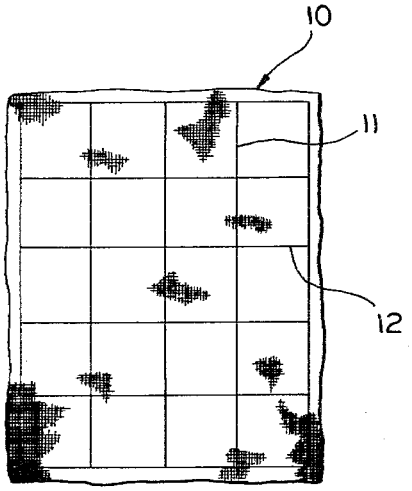
FIG. 1 of the drawings is a front elevational view of the fabric to be decorated by applicant's method having superimposed thereon a horizontal and verticle array.

While this invention is susceptible of embodiment in many different forms, there is shown in the drawings and will herein be described in detail one specific embodiment with the understanding that the present disclosure is to be considered as an exemplification of the principles of the invention and is not intended to limit the invention to the embodiment illustrated.

FIG. 1 of the drawings illustrates a piece of fabric 10 having superimposed thereon a linear array formed by vertical lines such as line 11 and horizontal lines such as line 12. While fabric 10 can be of virtually any type of material such as cotton, rayon, linen and silk, some preferred materials upon which the process is especially effective are 100% linen and 100% cotton velveteen.

Figure 2:
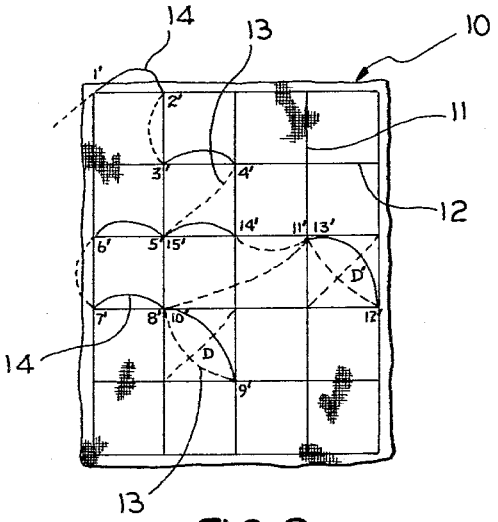
FIG. 2 is a front elevational view of the same arrayed piece of fabric having thereon an indication of the stitching and sewing pattern for smocking said fabric.

Fabric 10 is again shown in FIG. 2 of the drawings as are array lines 11 and 12. This particular drawing schematically illustrates one of several alternative methods of stitching and sewing through which smocking of the fabric can be obtained. Through such a process, portions of the fabric are gathered into juxtaposition with one another to form a plurality of ridges on the top side of the fabric. Numerals 1' through 15' illustrate in order the intersection points on the array which are penetrated by a needle in the sewing process and which are then drawn into juxtaposition with one another, respectively. Particularly, threads 13 come from behind the fabric 10 (as shown in dashed lines) towards the viewed, while threads 14 are positioned on top of the fabric. Thus, the thread penetrates array intersection position 1', continues on top of fabric 10 to position 2', at which point the thread penetrates array position 2' and is extended in like fashion from underneath fabric to array position 3'. For artistic and esthetic purposes, deviations wherein oblique or angled ridge formations are produced, can be, and often are incorporated into the design as shown by oblique deviations D and D'.

Figure 3:
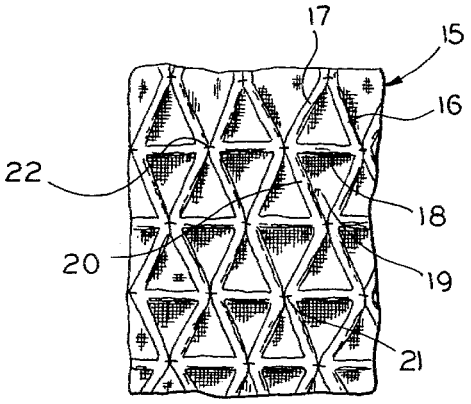
FIG. 3 is a front elevational view of the smocked article of fabric from the top side.

In FIG. 3 of the drawings, smock fabric 15 is shown with juxtaposed ridges 16, 17, 18 and 20. Also shown in FIG. 3 are recessed portions such as recessed portion 19, framed in by the juxtaposed ridges such as ridge 20. Also shown are material attachment means 21 and 22, which as shown by the schematic procedural step of FIG. 2, are the threads from the stitching and sewing operation through which smocking was accomplished.

Figure 4:
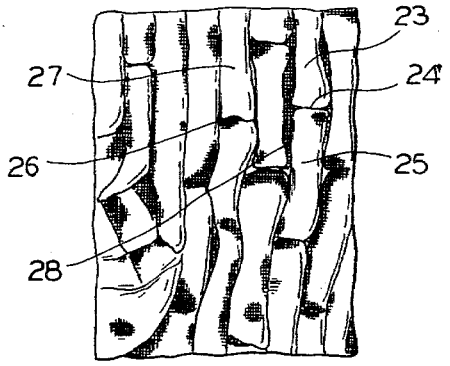
FIG. 4 is a back elevational view of the fabric showing the resulting reverse bottom side of the fabric after it has been smocked.

FIG. 4 shows the reverse side of the smocked fabric 15 of FIG. 3 showing particularly recessed portions 23, 25 and 27, (which appear recessed when viewing the smocked fabric from a front view as shown in FIG. 3). Positions 24, 26 and 28 show the raised portion of the smocked fabric which comprises the raised ridges shown in FIG. 3. It should be noted that because of the natural textile qualities and drape characteristics of the fabric that the back side is not a relief mirror image of front side shown in FIG. 3, but rather comprises a series of juxtaposed longitudinal sacks formed by the material between the ridges. It is the same bottom side of the fabric as shown in FIG. 4 upon which the dye diffusion means are applied, preferably through spraying.

Figure 5:
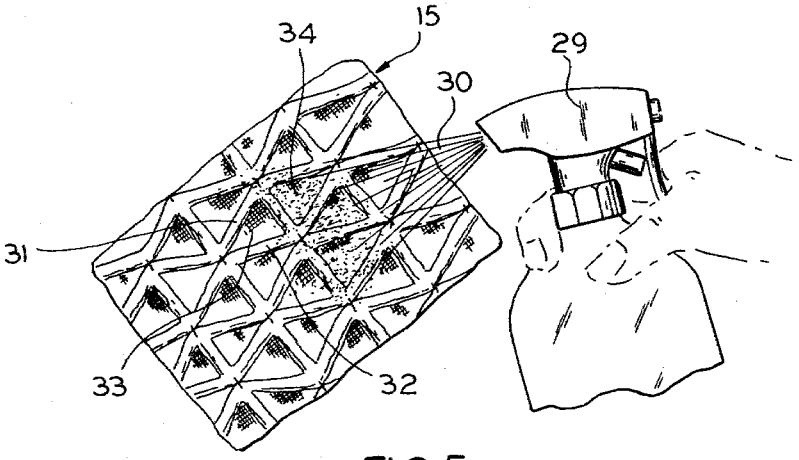
FIG. 5 is a side perspective schematic showing the spraying of the smocked fabric with dye means and/or dye means which have been mixed with stiffening agent.

In FIG. 5, sprayer 29 is used to apply dye means 30 which may also include a stiffening agent as described previously. Fabric 15 as it is smocked permits the accumulation of such dye from any of the plurality of dye applications in the recessed portions 34 and 33 of the smocked fabric as well as to the raised ridge portions 31 and 32.

Figure 6:
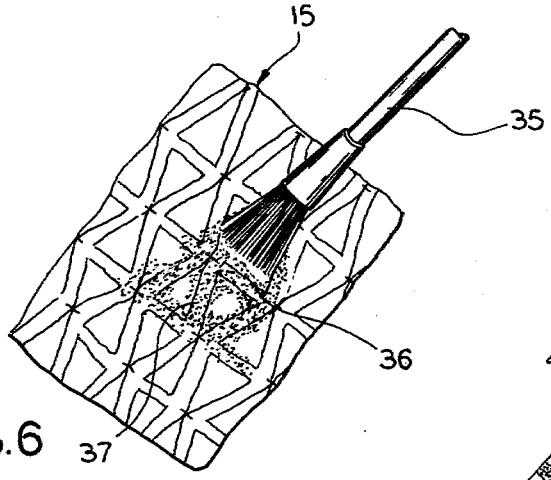
FIG. 6 is a top perspective view showing the procedure in which concentrated color dye agent is applied to the upper portions of the ridges.

FIG. 6 illustrates the application of concentrated color dye agent to the upper portions of the ridges by brush 35.

Figure 7:
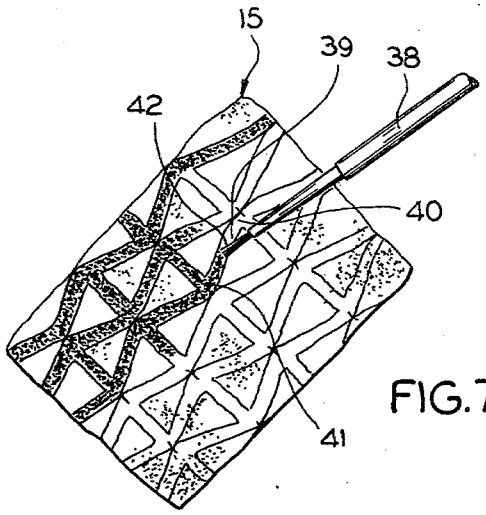
FIG. 7 is a top perspective view showing application of the outlining medium.

FIG. 7 equivalently illustrates the application of outlining medium 41 directly to the peaks of ridges 39, 40 and 42 by brush 38.

Figure 8:
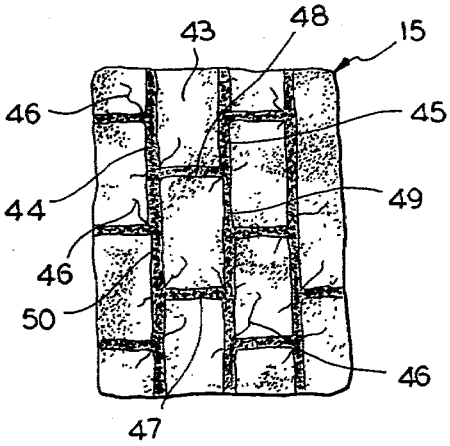
FIG. 8 is a front elevational view showing release of the material attachment means.

In FIG. 8 of the drawings, smocked fabric 15 has been released from its smocked configuration through the detachment of the stitching and sewing operation by threads 46. As shown in FIG. 8, the material has been substantially flattened to expose the three-dimensional looking cellular design wherein a bold cellular outline, colored by the outlining medium, is shown as boundary 45, while varying degrees of color and intensities progress inwardly to the middle of each described cell as shown by reference numeral 43.

Figure 9:
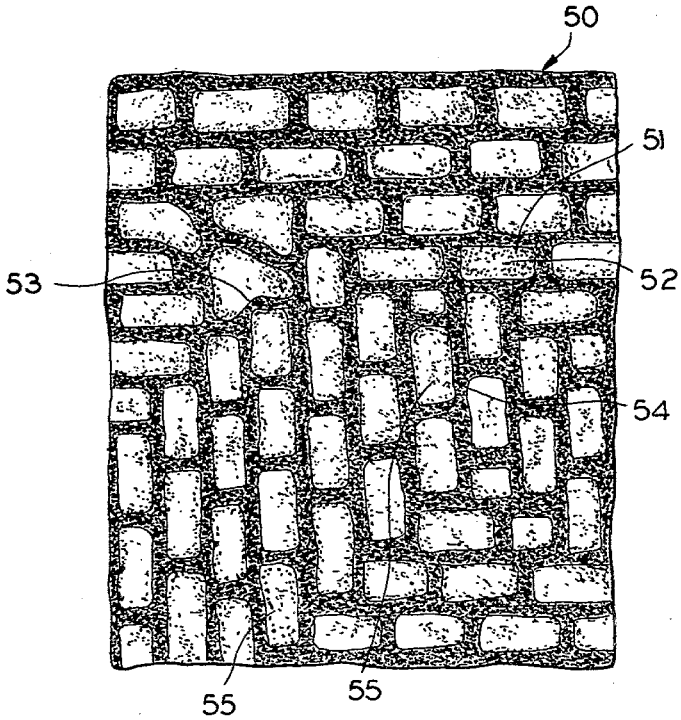
FIG. 9 is a front elevational view showing the applied design to a finished article.

A more encompassing overview of the finished fabric is shown in FIG. 9 wherein fabric 50 which has been rinsed as necessary, ironed and stretched.

As can be seen differentiation between the colors obtained through the various steps has occurred. Colors vary from the boundaries of the cells, such as boundary 54, to the areas immediately proximate to these boundaries, such as 51, all the way to the palest part of the cell, as designated by reference numeral 52. Dual designation numerals 55 designate the equivalent middle portions of yet other cells in a manner similar to that of reference numeral 52. The result of utilizing a deviation from the standard rectangular smocking routine as discussed previously, wherein smocking is altered through stitching and sewing on a diagonal to connect two opposed points is shown by reference numeral 53.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What I claim is:

1. An improved method for producing decorative fabric of the type wherein a desired geometrical design is imparted onto a fabric through dyeing, wherein said method comprises:

A. smocking said fabric by gathering portions of said fabric into juxtaposition so as to form a plurality of ridges on a top side of said fabric;

B. generally applying a plurality of color dye means to the exposed portions of said smocked fabric;

C. hardening said smocked fabric through stiffening means so as to stiffen said ridges on said top side of said fabric so as to make said ridges capable of maintaining said smocked position even when touched and manipulated;

D. applying a substantially concentrated color dye agent to the upper portions of said ridges;

E. outlining the uppermost peaks of said ridges with an outlining medium;

F. releasing said portions of said gathered fabric from said justaposition;

G. finishing said colored fabric having said desired design into decorative fabric material for use in such articles of apparel, wall decorations and upholstery material.

2. The method for producing decorative fabric according to claim 1 in which the method further comprises the step of:

moistening the smocked fabric with dye diffusion means for promoting the distribution of applied colors in the form of dyes.

3. The method according to claim 2 in which said moistening with dye diffusion means is accomplished by spray misting a bottom side of said fabric with dye diffusion solution.

4. The method according to claim 3 in which said dye diffusion solution comprises a mixture of water and crystalline urea in the ratio of four cups to ten tablespoons, respectively.

5. The method according to claim 2 in which said application of at least one of said plurality of color dye means is performed simultaneously with the step of hardening said smocked fabric by combining said at least one color dye means with a stiffening agent comprising said stiffening means, said combination of dye means and stiffening agent being applied by atomizer spray to the top side of said fabric and being absorbed into substantially unexposed portions of said smocked fabric by diffusion and further effectively being diffused by said dye diffusion means, said stiffening agent being curable to harden said fabric upon drying so as to maintain said ridges in substantially said smocked configuration.

6. The method according to claim 5 in which at least one of said plurality of color dye means comprises a fiber reactive dye, baking soda, washing soda, water and crystalline urea in the following ratio;

$\frac{1}{2}$ to 1 teaspoon of said dye depending on desired color intensity, $\frac{2}{3}$ teaspoon of said baking soda, $\frac{1}{3}$ teaspoon of said washing soda, $2\frac{1}{2}$ tablespoons of said crystalline urea, and 1 cup of said water.

7. The method according to claim 5 in which said stiffening agent comprises a solution of sodium alginate, crystalline urea, and water in the following ratio, said sodium alginate ranging in amount from $\frac{1}{4}$ to $\frac{1}{2}$ teaspoon, depending on desired stiffness, said crystalline urea being in the amount of 1 tablespoon, and said water being in the amount of substantially $\frac{1}{3}$ cup.

8. The method according to claim 5 in which said application of said combined dye means and stiffening agent comprises the steps of;

applying a first dye-agent mixture having a first substantially pale color over the exposed top surface of said fabric;

applying a second dye-agent mixture having a second color, substantially darker than said first pale color, over a lesser exposed area than said first color;

applying a third dye-agent mixture having a third color substantially darker than said second color over an even lesser exposed area of said fabric than that having said second color applied, said applications of said dye-agent mixtures applied without allowing the next preceeding application to dry, thereby promoting overlap and allowing blending to occur between said areas of dye-agent mixture application.

9. The method according to claim 2 in which said step of outlining the uppermost peaks of said ridges is accomplished by painting said peaks with outlining medium after said concentrated color dye agent, said stiffening means, said color dye means, and said dye diffusion means have dried.

10. The method according to claim 1 in which said operation of smocking includes the step of superimposing a substantially horizontal and vertical linear array onto a side of said fabric, said linear array being capable of describing a plurality of positions separated by standardized distances at which gathering of said portions of fabric in said justaposed manner is performed.

11. The method according to claim 10 in which said linear array comprises a plurality of horizontal parallel lines spaced $\frac{1}{2}''$ apart and a plurality of vertical paralled lines spaced $\frac{1}{2}''$ apart.

12. The method according to claim 10 in which said gathered portions of fabric are juxtaposed at the points of intersection described in said horizontal and vertical array.

13. The method according to claim 1 in which said operation of gathering is accomplished by attaching said portions of said fabric into juxtaposition and by affixing said portions into said juxtaposed position by material attachment.

14. The method according to claim 13 in which said material attachment comprises the steps of stitching and sewing.

15. The method according to claim 13 in which said step of releasing of said portions of gathered fabric is accomplished by severing said material attachment means.

16. The method according to claim 1 in which said step of applying said concentrated color dye agent to the upper portions of said ridges is accomplished by painting said upper portions with concentrated color dye agent.

17. The method according to claim 16 in which said concentrated color dye agent comprises a solution of fiber-reactive dye, baking soda, washing soda, water, crystalline urea, and sodium alginate in the following ratio, said amount of dye ranging in quantity from 1 to 1½ teaspoons depending upon desired color intensity;

said baking soda being in the amount of ⅔ teaspoon, said washing soda being in the amount of ⅓ teaspoon, said crystalline urea in the amount of 5 tablespoons, said water in the amount of 2 cups, and said sodium alginate in the amount of ¾ teaspoon, said concentrated color dye agent being applied to said upper portions of said ridges while said ridges are wet from said plurality of color dye means.

18. The method according to claim 1 in which said outlining medium comprises a solution of fiber-reactive dye, baking soda, washing soda, water, crystalline urea and sodium alginate in the following ratio;

1½ to 2 teaspoons of said dye,

⅔ teaspoon of baking soda,

⅓ teaspoon of washing soda, 1 cup water, and 1 teaspoon sodium alginate.

19. The method according to claim 1 in which said step of finishing includes the step of flattening said decorative fabric, after said step of releasing said gathered portions.

20. The method according to claim 19 in which the operation of finishing further includes rinsing said fabric, first in cold water, then in hot water, until bleeding of excess dye material ceases, said substantially flattened decorative fabric thereafter being ironed.

21. The method according to claim 20 in which the operation of finishing further includes the step of stretching said fabric so as to more effectively flatten said fabric so as to expose the imparted dye design.

* * * * *